US009556550B2

(12) United States Patent
Hildebrand et al.

(10) Patent No.: US 9,556,550 B2
(45) Date of Patent: Jan. 31, 2017

(54) DEVICE FOR THE WET-TREATMENT OF LAUNDRY

(71) Applicant: Herbert Kannegiesser GmbH, Vlotho (DE)

(72) Inventors: Jürgen Hildebrand, Hildesheim (DE); Wilhelm Bringewatt, Porta Westfalica (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 0 days.

(21) Appl. No.: 14/748,301

(22) Filed: Jun. 24, 2015

(65) Prior Publication Data

US 2016/0002840 A1 Jan. 7, 2016

(30) Foreign Application Priority Data

Jul. 2, 2014 (DE) ..... 10 2014 009 688

(51) Int. Cl.
*D06F 31/00* (2006.01)
*D06F 37/26* (2006.01)

(52) U.S. Cl.
CPC ..... *D06F 31/005* (2013.01); *D06F 31/00* (2013.01); *D06F 37/263* (2013.01)

(58) Field of Classification Search
CPC ..... D06F 31/00; D06F 31/005; D06F 37/263
USPC ..... 68/5 D, 5 E, 27, 140, 143, 145, 158
See application file for complete search history.

(56) References Cited

U.S. PATENT DOCUMENTS

2002/0083742 A1* 7/2002 Bringewatt ..... D06F 31/005 68/27
2007/0101512 A1* 5/2007 Lee ..... D06F 39/081 8/158

FOREIGN PATENT DOCUMENTS

DE 3903458 A1 8/1990
DE 4106621 A1 9/1992
DE 29514736 U1 12/1995
EP 1205590 A2 5/2002

OTHER PUBLICATIONS

European Patent Office, Europaischer Recherchenbericht (search on related application), Oct. 21, 2015.

* cited by examiner

*Primary Examiner* — Michael Barr
*Assistant Examiner* — Levon J Shahinian
(74) *Attorney, Agent, or Firm* — Laurence P. Colton; Smith Tempel BLaha LLC

(57) ABSTRACT

A device for the sealing of an external drum of a continuous-flow washing machines in relation to the internal drum in a more reliable manner and to prevent the risk of treatment liquid flooding from the one treatment chamber into the adjacent treatment chamber if a seal leaks by providing separate seals between adjacent external drums by each of the end faces of the adjacent external drums which point to one another having assigned thereto an own, preferably identically realized seal. In continuous-flow washing machines stationary external drums are assigned to some treatment chambers in a rotatingly drivable internal drum. Said stationary external drums have to be sealed relative to the treatment chambers of the rotatable internal drum. If one common seal is provided between adjacent external drums, if there are leaks, this results in total failure with treatment liquid flooding from the external drum into the adjacent external drum.

23 Claims, 2 Drawing Sheets

DEVICE FOR THE WET-TREATMENT OF LAUNDRY

STATEMENT OF RELATED APPLICATIONS

This application claims priority on and the benefit of German Patent Application No. 10 2014 009 688.2 having a filing date of 2 Jul. 2014.

BACKGROUND OF THE INVENTION

Technical Field

The invention relates to a device for the wet-treatment of laundry having a rotatingly driveable internal drum, which is liquid-permeable at least in part and in which treatment chambers, which follow one after another in the direction of its longitudinal center axis, are formed by partition walls, which extend perpendicular to the longitudinal center axis of the internal drum, and having at least two stationary external drums which are assigned to treatment chambers, wherein, support rings, which are sealed by means of seals in relation to the external drums, are provided between those treatment chambers, to which external drums are assigned.

Prior Art

The devices referred to here are so-called continuous-flow washing machines. They have a rotatingly driveable, elongated internal drum with partition walls which are at spacings in the longitudinal direction of said internal drum. The partition walls form treatment chambers which follow one after another in the internal drum. Some treatment chambers of the internal drum have assigned thereto a liquid-tight tub which, in specialist jargon, is designated as an external drum. Said external drum serves for receiving the treatment liquid, in particular washing liquid. So that the treatment liquid in the external drums is also able to pass into the internal drum, the lateral surface of the same is perforated at least in part in the region of the external drum.

In order to prevent the treatment liquid being able to pass in an uncontrolled manner from one treatment chamber to another, seals are provided in each case between adjacent external drums. The seals correspond with support rings which surround the outside of the internal drum.

In the case of known devices of the mentioned type (continuous-flow washing machines), a seal with two oppositely situated sealing lips is provided on opposite sides of the support ring in each case between two adjacent external drums. In the event of leakages, the result of these can be that treatment liquid passes from one external drum into the adjacent one. In addition, it is very difficult to adjust the single sealing lip where there are two connected sealing lips. In particular, it is very difficult to compensate for sealing lips that are worn to varying degrees.

BRIEF SUMMARY OF THE INVENTION

The object underlying the invention then is to create a device for the wet-treatment of laundry where reliable sealing is ensured between, in particular, adjacent external drums.

A device for achieving said object is a device for the wet-treatment of laundry having a rotatingly driveable internal drum, which is liquid-permeable at least in part and in which treatment chambers, which follow one after another in the direction of its longitudinal center axis, are formed by partition walls, which extend perpendicular to the longitudinal center axis of the internal drum, and having at least two stationary external drums which are assigned to treatment chambers, wherein, support rings, which are sealed by means of seals in relation to the external drums, are provided between those treatment chambers, to which external drums are assigned, characterized in that separate seals are provided for adjacent treatment chambers between in each case two adjacent external drums. In the case of said device, it is provided to arrange separate seals in each case between two adjacent external drums. As a result of the separate seals, if there are leakages from one seal, the treatment liquid emerging from said seal cannot pass into the adjacent treatment chamber. The different treatment liquids flooding from the one treatment chamber into another is reliably avoided as a result. In addition, the separate seals can be adjusted individually and only one seal needs to be replaced if a sealing lip is worn or damaged.

In a preferred manner, the seals which are assigned to the two adjacent external drums are operative in opposite directions. In particular, sealing edges on free ends of the sealing lips of the two adjacent seals point to one another. In the case of said arrangement, the separate seals, in particular the sealing forces by way of which the sealing lips press the sealing edges and consequently corresponding support rings against the outside circumference of the internal drum, do not influence one another. In addition, the sealing lips with the sealing edges in each of the adjacent external drums are pressed by the treatment liquid contained therein against the support surfaces of the support rings and as a result the sealing effect of each seal is individually strengthened.

It is particularly advantageous to arrange the two seals in a parallel manner between adjacent external drums, in particular when their sealing lips with the sealing edges are oriented in opposite directions in a mirror-inverted manner. The parallel arrangement of the two seals allows one end face of the adjacent external drums to be sealed with each seal in relation to the internal drum or to its at least one support ring. As a result of the parallel arrangement, the seals are also able to be mounted, adjusted and, where applicable, re-adjusted in a simple manner from the associated end faces of the external drums.

According to an advantageous development possibility of the device, it is provided to assign identically or similarly realized seals to the two adjacent external drums. Each of the seals has one single sealing lip with a sealing edge that is arranged on the free end of the same. In the case of seals oriented in opposite directions between adjacent external drums, the sealing edges of the two adjacent seals then point to one another such that they abut in a sealing manner from opposite sides against oppositely situated circular surfaces of the single support ring or abut sealingly with elastic pre-stressing against outside sealing surfaces of parallel support rings. Said orientation of the identical seals, even where there are different levels of treatment liquid in the adjacent external drums or treatment liquid in only one single external drum, ensures efficient sealing and spreading of treatment liquid from the one external drum into the adjacent one.

According to the invention, different development possibilities of the device are conceivable. One development possibility provides assigning the two seals to one identical support ring of the internal drum. Said support ring is then formed in a preferred manner by a partition wall, the outside diameter of which is greater than the outside diameter of the internal drum such that the partition wall with its circular region protrudes in a circumferential manner on the outside in relation to the lateral surface of the internal drum. The support ring can be formed in a very simple manner in this way. In the case of said single support ring, the seals are arranged on oppositely situated sides of the same, such that the sealing edges of the seals press in a sealing manner against oppositely situated circular support surfaces of the outer support ring. In this way, each end face of the adjacent external drums is sealed between the adjacent external drums by a separate seal assigned to it in relation to the support ring of the partition wall which rotates with the rotatably driveable internal drum. As an alternative to this, it is conceivable to assign an own support ring to seals assigned to each of the two adjacent external drums. The two support rings are positioned between the adjacent external drums and are preferably spaced apart from one another, such that they are located in parallel planes which extend transversely with respect to the longitudinal center axis of the rotatably drivable drum. As a result of the spaced apart, separate support rings, the separate seals can be spaced apart so far from one another that they are easily mountable and individually adjustable. One of the two parallel support rings is formed in a preferred manner by a partition wall, whilst the other support ring is formed by a separate circular ring which, at a spacing from the partition wall, surrounds the internal drum on the outside in a circumferential manner and is connected on the outside to the lateral surface of the internal drum in a fixed and liquid-tight manner, preferably by means of welding.

Where there are two spaced-apart support rings, in a preferred manner one seal is assigned to each support ring, in such a manner that the sealing edges of the sealing lips of said seals press from the outside against the one and the other support ring. Thus, a sealed spaced is created between the spaced-apart, parallel support rings.

In the case of an advantageous development possibility of the invention, each seal comprises a preferably cylindrical foot portion which is surrounded in a ring-like manner on the inside by the sealing lip. The foot portion of each seal is assigned to an end-face edge region of the external drum which is to be sealed by the seal in relation to the support ring on the rotatingly driveable internal drum.

The foot portion of the respective seal is preferably realized in a cylindrical manner, such that it surrounds the end-face edge region of the relevant external drum on the outside. In a preferred manner, it is provided to fasten the seal with the cylindrical foot portion in a releasable manner to the edge region of the external drum assigned to it. As a result of the releasable fastening, it is possible to mount, adjust, and, in the event of wear, to re-adjust the seal easily. The cylindrical realization of the foot portion ensures the seal holds reliably on the relevant end-face edge region of the external drum and additionally causes the seal to center.

The seal with the foot portion is usually formed from an elastic material, as a result of which the seal is easily slippable onto the end-face edge region of the external drum and, where required, enables axial displacement in the direction of the longitudinal center axis of the internal drum, on which the longitudinal center axis of the external drum also lies.

In a preferred manner, the seals and their cylindrical foot portions are dimensioned such that the foot portions, in the case of adjacent seals, are at a spacing which is sufficient in order to enable them to be re-adjusted as a result of pushing them together and, at the same time, a sufficient spacing still remains between the end faces of the foot portions directed toward one another.

An advantageous further development possibility of the device provides assigning at least one outer liquid-catching tray to the two seals between adjacent external drums, preferably a space between adjacent seals or foot portions in at least one lower region. The collecting tray receives treatment liquid which passes through the seal, in particular smaller volumes of leaking liquid, but also treatment liquid emerging on account of leakages of at least one seal. As a result of a flow measuring device provided where applicable in the collecting tray, the extent of the treatment liquid caught by said tray can be detected and in this manner it can be ascertained whether it is only a question of small volumes of leaking liquid or of larger leakages. Where applicable, an own collecting tray can be assigned to each seal or one divided collecting tray can be provided. Thus, it can be ascertained through which seal treatment liquid is escaping and to what extent. The operational reliability of the device is clearly increased with this measure.

BRIEF DESCRIPTION OF THE DRAWINGS

Preferred exemplary embodiments of the invention are explained in more detail below by way of the drawing, in which.

DETAILED DESCRIPTION OF PREFERRED EMBODIMENTS

Figure 1:
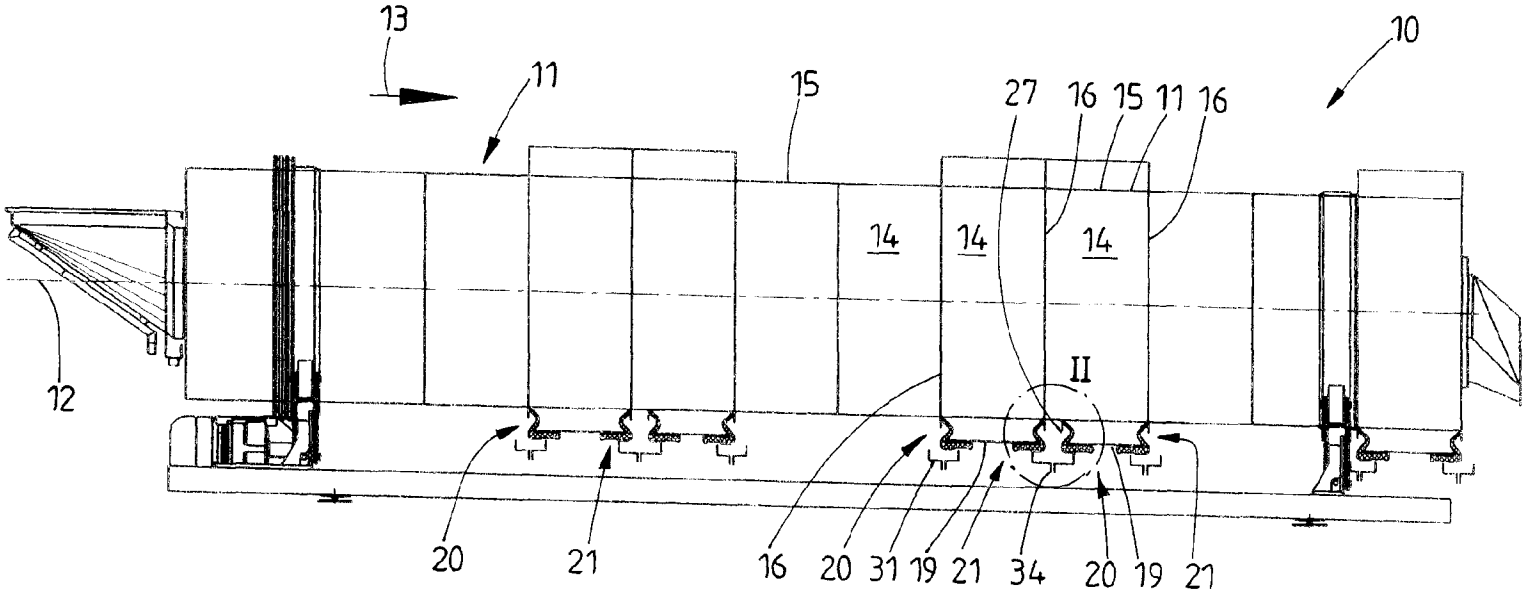
FIG. 1 shows a schematic side view of a device for the wet-treatment of laundry.

The device shown in the Figures is a continuous-flow washing machine 10 which is predominantly used in industrial laundries. Such a continuous-flow washing machine 10 serves for the batch-type washing and, where applicable, rinsing and/or post-treating of laundry items that are not shown in the Figures.

The continuous-flow washing machine 10 has an elongated internal drum 11 which is rotatably driveable about a horizontal longitudinal center axis 12. The internal drum 11 of the continuous-flow washing machine 10 is divided into different treatment chambers 14 which follow one after another in the movement direction 13 of the laundry items through the continuous-flow washing machine 10. One or preferably several treatment chambers 14 following one after another form different treatment zones in the internal drum 11 of the continuous-flow washing machine 10. For example, these are a pre-wash zone at the beginning of the internal drum 11, a main wash zone and, where applicable, also a rinse zone and/or a post-treatment zone. The number and the size of the treatment chambers 14 following one after another per zone can vary depending on the size and capacity of the continuous-flow washing machine 10. The continuous-flow washing machine 10 shown in FIG. 1 has a pre-wash zone, a main wash zone which follows this in the movement direction 13 and a rinse zone which connects thereto. The invention is also suitable for a continuous-flow washing machine 10 with only one pre-wash zone and one main wash zone as well as, where applicable, a post-treatment zone. In the case of such a continuous-flow washing machine 10, the rinsing takes place in a subsequent draining device.

The one-piece internal drum 11 is substantially formed from cylindrical drum portions 15 and cylindrical partition walls 16, so-called rounds, which are arranged between adjacent drum portions 15 and connect said drum portions. Each drum portion 15 between two adjacent partition walls 16 forms a treatment chamber 14 including the adjacent partition walls 16. The walls of the drum portions 15 can be completely or partially liquid-permeable, in particular they can comprise a grid produced from a plurality of preferably identical perforation holes 17. The partition walls 17 which extend perpendicular to the longitudinal center axis 12 are fixedly connected, preferably welded in a liquid-tight manner, to the end faces of the cylindrical drum portions 15.

The cylindrical partition walls 16 comprise an outside diameter which is greater than the outside diameter of the cylindrical lateral surfaces of the drum portions 15 and of the internal drum 11. The partition walls 16, which are greater in diameter compared to the internal drum 11, as a result protrude on the outside in relation to the inner drum 11 by comprising a circular ring which surrounds the internal drum 11 in a circumferential manner and forms a circular support ring with support surfaces 18 on both sides. At least some partition walls 16, in particular between two treatment zones following one after another, can be thermally insulated. It is preferred for such partition walls 16 to be constructed in a sandwich-like manner with a central insulating layer and two oppositely situated outer cylindrical cover plates produced, for example, from high-grade steel, in particular high-grade stainless steel.

In the region of some treatment chambers 14, the cylindrical internal drum 11 is surrounded by a fixed, liquid-tight external drum 19. In the exemplary embodiment shown, external drums 19 are only assigned to the last treatment chamber 14 of the pre-wash zone, the main wash zone and the rinse zone as well as the first treatment chambers 14 of the main wash zone and the rinse zone. As a result, two adjacent external drums 19, which are preferably identically realized, but where applicable can have different lengths, are situated at the transition between the pre-wash zone and the main wash zone as well as the main wash zone and the rinse zone. The external drums 19 have a larger diameter than the internal drum 11. In addition, the diameter of the external drums 19 is somewhat greater than the outside diameter of the partition walls 16, which are greater compared to the internal drum 11, or the support surfaces 18 formed by said partition walls around the internal drum 11. The external drums 19—as in the exemplary embodiment shown in FIG. 1—can surround the internal drum 11 completely at a spacing, as an alternative to this, however, they can extend only over a lower part of the internal drum 11, for example they can be realized as a half-drum or semi-circular drum. These are then tray-like external drums 19. Such only tray-like external drums 19 are also designated in specialist jargon, and consequently here also, as "external drums".

The external drums 19 are stationary in contrast to the rotatingly drivable internal drum 11, that is they do not rotate with the internal drum 11. The external drums 19 are realized in a fully liquid-tight manner, whereas the drum portions 15 which are situated in the region of the external drums 19, for forming the internal drum 11, are realized so as to be liquid-permeable at least in part by means of a grid which is produced from a plurality of perforation holes 17 in its lateral surface.

Each external drum 19 is formed only from one preferably cylindrical or part-cylindrical lateral surface. The end faces of the external drums 19 are consequently open. So that the external drums 19 are nevertheless liquid-tight, the open end faces of the external drums 19 are sealed by seals 20, 21 and the support rings. Each external drum 19 comprises a seal 20, 21 on its oppositely situated end faces. Accordingly, two seals 20, 21 are provided between two adjacent external drums 19 and one seal 20, 21 is provided on outer end faces of each external drum 19. All in all, the two external drums 19 of adjacent treatment chambers 14 which are located side by side are sealed by four seals 20, 21 in relation to the internal drum 11, quasi each seal 20, 21 forming part of each end wall of the external drum 19. The seals 20, 21 are realized identically in the exemplary embodiments shown. They are, however, oriented differently, namely they are assigned in a rotated or mirror-inverted manner to the oppositely situated end faces of the external drums 19. The two seals 20, 21 between two adjacent external drums 19 are also oriented in opposite directions. Thus, the seals 20 on the left-hand end faces of the external drums 19 are oriented in an opposite direction to the seals 21 on the right-hand end faces of the external drums 9.

Each of the identically realized seals 20, 21—apart from the partially different orientations—has a sealing lip 22 and a foot portion 23 which is integrally moulded thereon. The entire seal 20 or 21, that is the sealing lip 22 and the foot portion 23 of the same, are formed from an elastic material such as an elastomer, rubber or the like. The foot portion 23 and the sealing lip 22 extend at an angle with respect to one another such that an approximately L-shaped profile of each seal 20, 21 is created. The sealing lip 22 extends for instance in a plane parallel to the partition wall 16 such that it forms quasi part of an end face of the respective external drum 19. In contrast, the foot portion 23 extends parallel to the lateral surface of the external drum 19, overlapping the outside of an edge region of the same which proceeds from the end face of the external drum 19. In the case of cylindrical external drums 19, the foot portion 23 also has a cylindrical shape by said foot portion surrounding the cylindrical external drum 19 from the outside. Accordingly, the sealing lip 22 which is angled with respect to the foot portion 23 is approximately circular in shape.

The sealing lip 22 is inclined at least on the free end located opposite the foot portion 23, such that it is directed away from the foot portion 23 toward the free end. As a result, a sealing edge 24 is created on the free end of the sealing lip 22 on the side of the sealing lip 22 directed away from foot portion 23. By way of the sealing edge 24, the seal 20, 21 seals the respective end face of the external drum 19 against the circular support surface 18 that surrounds the internal drum 11.

Apart from this, the sealing lip 22 is formed from two differently directed, somewhat angled portions 25 and 26. The portions 25 and 26, which are approximately the same length and directed differently, are connected in one piece. An upper portion supports a sealing edge 24 on the upper end, whilst a lower portion 26 is integrally connected to the foot portion 23. The two portions 25, 26 of the sealing lip 22 are angled such that their enclosed angle is situated on the side of the sealing edge 24, that is of the support surface 18 assigned to the sealing edge 24.

Figure 2:
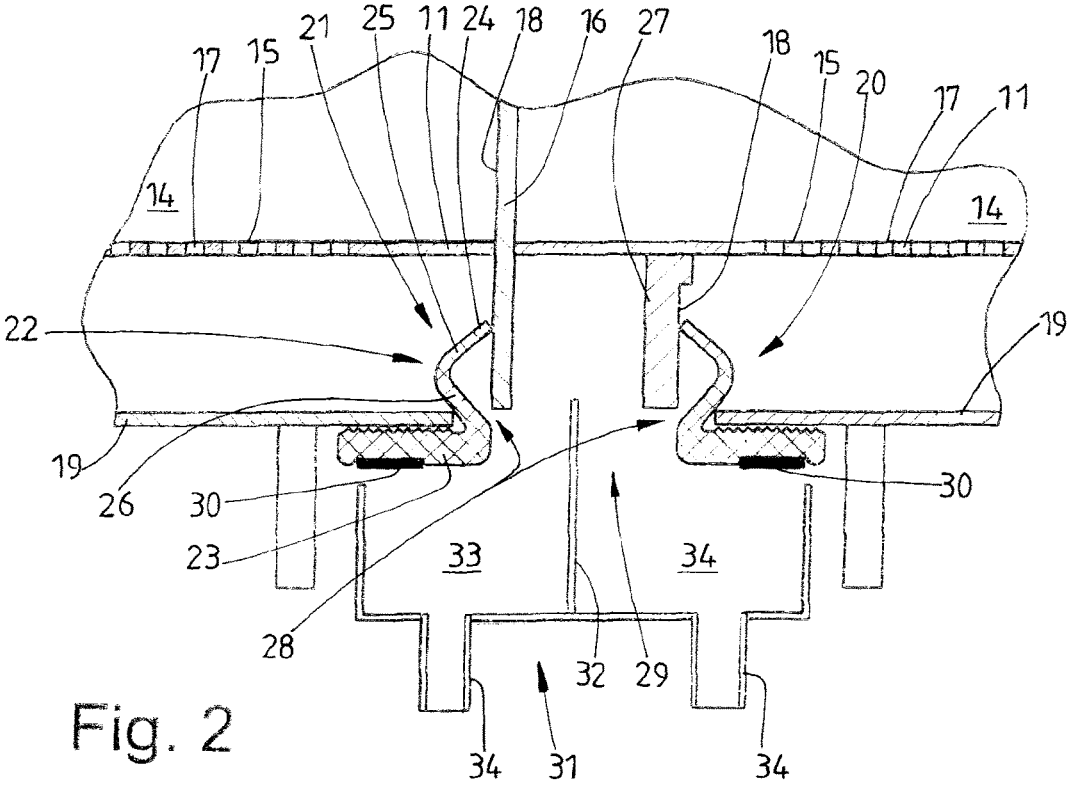
FIG. 2 shows an enlarged detail II from FIG. 1.

In the case of the exemplary embodiment of FIGS. 1 and 2, an own support surface 18 is assigned to each of the two seals 20, 21 between adjacent external drums 19. The left-hand seal 21, with reference to the representation of FIG. 2, is assigned to the support surface 18 that is formed by the partition wall 16. Accordingly, the right-hand seal 20 in FIG. 2 is assigned to the support surface 18 with a separate circular ring 27. Said ring 27 surrounds the drum lateral surface of the internal drum 11 from the outside and is connected hereto in a fixed and liquid-tight manner, for example as a result of welding. The ring 27 is spaced somewhat from the partition wall 16. The ring 27 is fastened on such an end region of the drum portion 15 of the internal drum 11 which does not comprise any perforation holes 17 and is consequently liquid-impermeable. The outside diameter of the ring 27 is the same size as the outside diameter of the partition wall 16. These identical outside diameters are somewhat smaller than the inside diameter of the external drum 19 such that a space 28 is created between the open end face of the respective external drum 19 and the outside circumference of the partition wall 16 and of the ring 27 so that the sealing lip 22 of the respective seal 20, 21 is able to pass through. The (right-hand) circular surface of the ring 27, which points to the interior of the external drum 19, forms the support surface 18 for the sealing abutment of the sealing edge 24 of the sealing lip 22 of the seal 20. The oppositely situated ring surface of the partition wall 16, which points to the interior of the adjacent (left-hand) external drum 19, forms the support surface 18 for the sealing abutment of the sealing edge 24 of the second seal 21 of the adjacent external drum 19. The support surfaces 18 for the two 20, 21 assigned to adjacent external drums 19 are consequently assigned to outside surfaces of the ring 27 and of the partition wall 16 which are directed away from one another.

The seals 20, 21 are connected in a releasable manner to the respective edge region of the external drums 19 by way of their foot portions 23. To this end, the foot portions 23 abut against the outside surfaces of the edge regions of the external drums 19 preferably with electrical pre-stressing. With the seal 20, 21 arranged between adjacent external drums 19 according to the representation of FIG. 2, the foot portions 23 are directed away from one another. As a result, a circumferential gap 29 is created between the adjacent seals 20, 21 of the external drums 19 which are located side by side. The foot portions 23 of the two adjacent seals 20, 21 are also spaced apart from one another in said gap 29.

In the exemplary embodiment shown, the seals 20, 21 are releasably fixed on the outside surface of the respective edge region of the external drum 19 by a circumferential clamping ring 30. Each clamping ring 30 comprises a turnbuckle (not shown), as a result of which the circumference thereof is reducible for elastically pressing and non-displaceably fixing the seals 20, 21 with their foot portions 23 on the outside surface of the edge region of the respective external drum 19. As a result of releasing the turnbuckle, the clamping rings 30 can be widened for displacing the respective seal 20, 21 in the direction of the longitudinal center axis 12 of the internal drum 11 of the continuous-flow washing machine 10. The elastic pre-stressing of the sealing lip 22 can be changed in this way, in particular can be enlarged again when the sealing lips 22 are worn. In this connection, the respective seal 20 or 21 is displaced such that its sealing lip 22 with the sealing edge 24 reaches the respective support surface 18 in a tighter manner and as a result the sealing edge 24 of the sealing lip 22, which is pre-stressed in a more elastic manner, presses against the respective support surface 18 with greater force and consequently providing reliable sealing. Due to separate seals 20, 21 between adjacent external drums 19, each seal 20, 21 can be adjusted individually as a result of axial displacement such that it produces sufficient and reliable sealing of the fixed external drum 19 in relation to the support surface 18, that is in relation to the partition wall 16 or the ring 27 of the rotatingly driven internal drum 11.

A fixed collecting tray 31 is arranged below the two seals 20, 21 between adjacent external drums 19. The box-shaped collecting tray 31, which is open at the top, serves for collecting leaking liquid or treatment liquid which has escaped from the external drum 19 due to a non-tight seal 20, 21. The collecting tray 31 shown is preferably divided by a partition wall 32 in the middle into two collecting tray halves 33 which are located side by side. The seal 20 is assigned to the one collecting tray half 33 and the seal 21 is assigned to the other collecting tray half 53 such that escaping treatment liquid or leakage liquid is collected in front of each seal 20, 21 in a separate collecting tray half 33. In the exemplary embodiment shown, each collecting tray half 33, with a connecting piece 34 for a discharge line, for example a hose (not shown), is assigned to the treatment liquid or leakage liquid collected. As a result of arranging a liquid sensor (not shown) in the respective connecting piece 34, the liquid volume draining through said connecting piece per unit time can be detected. It can be detected in this way whether the liquid accrued per unit time is within the framework of what is usual or is higher than average. In the last-mentioned case, the flow rates of the measuring device can output a signal which is an indication that the seal 20 or 21 is non-tight as a result of wear or damage.

Figure 3:
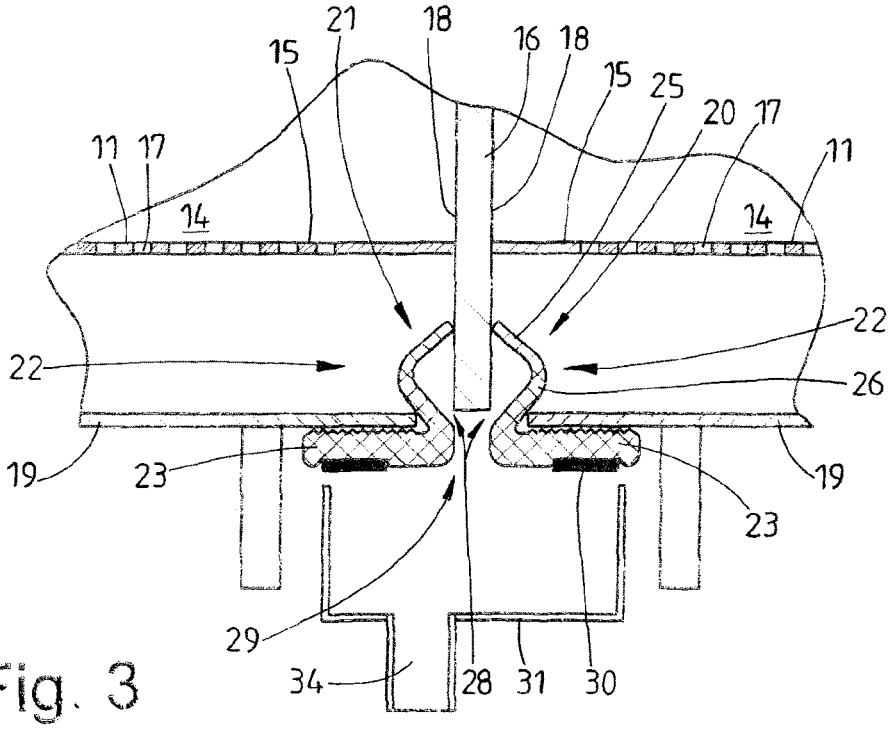
FIG. 3 shows a representation analogous to FIG. 2 of an alternative exemplary embodiment.

FIG. 3 shows an alternative exemplary embodiment of the sealing in relation to an adjacent external drum 19. In principle, said exemplary embodiment corresponds to that of FIGS. 1 and 2, which is why identical reference numbers are used for identical parts. In particular, the seals 20, 21 in the case of the exemplary embodiment of FIG. 3 correspond to the seals 20, 21 described beforehand.

The essential difference between the exemplary embodiment of FIG. 3 and FIG. 2 is that the ring 27 of the exemplary embodiment of FIGS. 1 and 2 is omitted. Accordingly, the two oppositely situated sides of the outer ring region or support ring of the partition wall 16, which protrude in relation to the internal drum 11, serve as support surfaces 18. As a result, the sealing edges 24 of the two separate seals 20, 21 are located between the external drums 19 on opposite sides of the ring region of an identical partition wall 16 which protrudes in relation to the internal drum 11. The seals 20, 21, in particular their sealing lips 22, are formed such that with the sealing edges 24 of the sealing lips 22 abutting against the two oppositely situated sides of the partition wall, the foot portions 23 do not touch each other, that is a sufficient gap 29 still remains between the same in order to be able to adjust the sealing action of the seals 20, 21 individually as a result of displacing the seals 20, 21 axially in the direction of the longitudinal center axis 12 of the internal drum 11 and the external drum 19.

In the exemplary embodiment shown, the collecting tray 31, which is arranged below the two separate seals 20, 21 between the adjacent external drums 19, is only provided with one single common chamber which collects leakage liquid or treatment liquid which escape as a result of leakages at the sealing points of both seals 20, 21 and said liquids are able to drain away via a connecting piece 34. Where applicable, a flow meter can be assigned to the connecting piece 34 in order to be able to ascertain whether and how much treatment liquid or leakage liquid drains from the collecting tray 31 per unit time.

However, it is also conceivable to provide the collecting tray 31 shown in FIG. 2 with two separate collecting tray halves for each individual seal 20, 21 for the exemplary embodiment of FIG. 3.

Common to all the exemplary embodiments shown of the invention is that the stationary external drums 19, which are open on oppositely situated end faces, are sealed on their end faces by, on the one hand, support rings of the partition walls 16 or rings 27 which protrude in relation to the outside diameter of the internal drum 11 and circulate in a rotating manner with the internal drum 11, and, on the other hand, the stationary seals 20, 21 which are fastened on the external drum 19. The oppositely situated end faces of each external drum 19 are sealed by own seals 20, 21, it being preferred that all seals 20, 21 are realized identically but are oriented in a mirror-inverted manner. In particular, it is achieved as a result of the sealing between adjacent external drums 19 by separate seals 20, 21 that pressure differences in the adjacent external drums 19, which are brought about as a result of different levels of treatment liquids in the adjacent treatment chambers 14 or in the external drums 19 assigned to said treatment chambers, do not influence the adjacent seals 20, 21 because they are separate. For the same reason, a leak in one seal 20, 21 does not result in the sealing edge 24 of the adjacent seal 20, 21 being raised from the support surface 18 assigned to it and, as a result, treatment liquid escaping from the one external drum 100 being able to flow into the adjacent external drum 19, which could result in flooding. Finally, the separate seals 20, 21 between adjacent external drums 19 allow leakage liquid or treatment liquid to be drained off and collected in the event of a non-tight seal 20, 21.

Due to the separate seals 20, 21 between adjacent external drums 19, the sealing of the two oppositely situated end faces of each external drum 19 is effected in an identical manner and preferably with the identical seals 20, 21. To this end, the seals 20, 21 on oppositely situated end faces of each external drum 19 are oriented in a reversed manner, i.e. in a mirror-inverted manner, with respect to one another such that their sealing edges 24 on oppositely situated end faces of their external drum 19 point outwards and in an elastically pre-stressed manner press against the respectively oppositely situated end faces of the partition walls 16 and/or rings 27 assigned to the external drum 19.

LIST OF REFERENCE NUMERALS

10 Continuous-flow washing machine
11 Internal drum
12 Longitudinal center axis
13 Movement direction
14 Treatment chamber
15 Drum portion
16 Partition wall
17 Perforation hole
18 Support surface
19 External drum
20 Seal
21 Seal
22 Sealing lip
23 Foot portion
24 Sealing edge
25 Portion
26 Portion
27 Ring
28 Space
29 Gap
30 Clamping ring
31 Collecting tray
32 Partition wall
33 Collecting tray half
34 Connecting piece

What is claimed is:

1. A device for the wet-treatment of laundry comprising:

a rotatingly driveable internal drum (11), which is liquid-permeable at least in part and in which treatment chambers (14), which follow one after another in the direction of its longitudinal center axis (12), are formed by partition walls (16), which extend perpendicular to the longitudinal center axis (12) of the internal drum (11);

at least two stationary external drums (19) which are assigned to the treatment chambers (14), wherein, support rings, which are sealed by means of seals (20, 21) in relation to the external drums (19), are provided between those treatment chambers (14), to which the external drums (19) are assigned, wherein two separate seals (20, 21), operative in opposite directions, are provided for adjacent treatment chambers (14) between in each case two adjacent external drums (19), wherein each of the seals (20, 21) comprises a cylindrical foot portion (23) which surrounds the outside of an end-face edge region of the external drum (19) which is assigned to a respective one of the seals (20, 21), and wherein sealing edges (24) on free ends of sealing lips (22) of the two separate seals (20, 21) point to one another.

2. The device according to claim 1, wherein the two separate seals (20, 21) are arranged between adjacent external drums (19).

3. The device according to claim 1, wherein the two separate seals (20, 21) are oriented in a parallel manner between adjacent external drums (19).

4. The device according to claim 1, wherein the seals (20, 21) which are arranged between adjacent external drums (19) are realized identically or in a similar manner and/or the seals (20, 21) are oriented in an opposite or mirror-inverted manner relative to each other.

5. The device according to claim 1, wherein the two separate seals (20, 21) in each case between two adjacent external drums (19) are assigned to an identical support ring on the outside circumference of the internal drum (20, 21), whereby sealing edges (24) of the two separate seals (20, 21) abut in a sealing manner against support surfaces (18) of oppositely located sides of the support ring.

6. The device according to claim 5, wherein at least one support ring is formed by a partition wall (16) of the internal drum (11) by the outside diameter of the partition wall (16) being greater than the diameter of the internal drum (11) and the support ring being situated between the outside circumference of the internal drum (19) and the greater outside diameter of the partition wall (16).

7. The device according to claim 1, wherein each of the seals (20, 21) assigned to the two adjacent external drums (19) have assigned thereto an own support ring, wherein the two support rings are situated between the adjacent external drums (19) and/or are spaced apart from one another.

8. The device according to claim 7, wherein the two separate seals (20, 21) are assigned to outside end faces of the two support rings which are directed away from one another, whereby sealing edges (24) of the two separate seals (20, 21) abut in a sealing manner against support surfaces (18) of oppositely situated external end faces of the support rings.

9. The device according to claim 7, wherein the second support ring is formed by a separate ring (27) which surrounds the internal drum (11) and is connected to the internal drum (11) in a liquid-tight manner.

10. The device according to claim 7, wherein the two separate seals (20, 21) are assigned to outside end faces of the two support rings which are directed away from one another.

11. The device according to claim 7, wherein the second support ring is formed by a separate ring (27) which surrounds the internal drum (11) and is connected to the internal drum (11).

12. The device according to claim 1, wherein the external drums (19) comprise open end faces and the open end faces of the external drums (19), namely two oppositely situated end faces of each external drum (19), also of adjacent external drums (19), have assigned thereto a separate seal (20, 21) for sealing the two open end faces of the external drums (19).

13. The device according to claim 1, wherein one end of the foot portion is connected in one piece to the sealing lip (22), whereby the seal (20, 21) is fastened to the foot portion (23) in a releasable manner on the end-face edge region of the external drum (19) assigned thereto.

14. The device according to claim 13, wherein the seals (20, 21) between adjacent external drums (19) are spaced apart from one another, and the foot portions (23) of the two separate seals (20, 21) are fastened in a releasable manner at a spacing from one another on the outside of the adjacent end-face edge regions of external drums (19) which are arranged side by side.

15. The device according to claim 13, wherein the seals (20, 21) between adjacent external drums (19) are spaced apart from one another.

16. The device according to claim 1, wherein at least one collecting tray (31) for leakage liquids and/or treatment liquids is assigned to the two separate seals (20, 21) between adjacent external drums (19) in a space between the adjacent seals (20, 21), at least in a bottom region.

17. The device according to claim 1, wherein the two separate seals (20, 21) in each case between two adjacent external drums (19) are assigned to an identical support ring on the outside circumference of the internal drum (20, 21).

18. The device according to claim 17, wherein at least one support ring is formed by a partition wall (16) of the internal drum (11) by the outside diameter of the partition wall (16) being greater than the diameter of the internal drum (11) and the support ring being situated between the outside circumference of the internal drum (19) and the greater outside diameter of the partition wall (16).

19. The device according to claim 1, wherein each of the seals (20, 21) assigned to the two adjacent external drums (19) have assigned thereto a support ring.

20. The device according to claim 1, wherein the external drums (19) comprise open end faces and the open end faces of the external drums (19) have assigned thereto a separate seal (20, 21) for sealing the two open end faces of the external drums (19).

21. The device according to claim 1, wherein each of the seals (20, 21) comprises a foot portion (23) which surrounds the outside of an end-face edge region of the external drum (19) which is assigned to a respective one of the seals (20, 21) and on one end is connected in one piece to the sealing lip (22).

22. The device according to claim 21, wherein the seal (20, 21) is fastened to the foot portion (23) in a releasable manner on the end-face edge region of the external drum (19) assigned thereto.

23. The device according to claim 1, wherein at least one collecting tray (31) for leakage liquids and/or treatment liquids is assigned to the two separate seals (20, 21) between adjacent external drums (19).

* * * * *